United States Patent [19]

McKiel, Jr.

[11] 4,398,475

[45] Aug. 16, 1983

[54] HAZARDOUS WASTE INCINERATION SYSTEM

[75] Inventor: Charles W. McKiel, Jr., Oak Park, Ill.

[73] Assignee: SSK Corporation, Bensenville, Ill.

[21] Appl. No.: 273,754

[22] Filed: Jun. 15, 1981

[51] Int. Cl.[3] ..... F23G 7/04

[52] U.S. Cl. ..... 110/346; 110/210; 110/237; 110/238

[58] Field of Search ..... 110/346, 235, 210, 237, 110/238; 431/2; 422/172

[56] References Cited

U.S. PATENT DOCUMENTS 3,918,374 11/1975 Yamamoto et al. ..... 110/346

4,179,263 12/1979 Jung et al. ..... 110/346 X 4,183,307 1/1980 Spitz et al. ..... 110/346 X

*Primary Examiner*—Edward G. Favors

*Attorney, Agent, or Firm*—Mason, Kolehmainen, Rathburn & Wyss

[57] ABSTRACT

A hazardous waste incineration system is provided in which a series of interconnected combustion chambers are employed to obtain successively higher temperatures in successive chambers, the gaseous products of combustion in each chamber being supplied to the next chamber in the series to act as a high temperature environment and promote the burning of hazardous wastes in successive chambers which require successively higher temperatures to become volatilized and break down into their constituent elements. Preferably, the successive chambers have successively larger volumes so that successively greater amounts of hazardous wastes, which may be of successively lower heat values and require successively higher temperatures to be broken down, may be burned in the successive combustion chambers of the series.

18 Claims, 5 Drawing Figures

HAZARDOUS WASTE INCINERATION SYSTEM

FIELD OF THE INVENTION

The present invention relates generally to the field of incineration, and, more particularly, to methods for destroying hazardous wastes by incineration. For the purposes of this invention, incineration may be defined as the controlled process by which solid, liquid or gaseous combustible wastes are burned and changed into gases and the residue produced contains little or no combustible material.

The Environmental Protection Agency has now issued detailed regulations on the management, use, reuse and destruction of a large number of industrial and agricultural wastes which have been classified as hazardous wastes. The EPA has also introduced strict requirements concerning the incineration of hazardous wastes and has specified that certain wastes must be destroyed with a destruction efficiency of 99.9999% so that only one part per million of the hazardous waste remains or is released to the atmosphere. With certain highly combustible hazardous wastes, such as contaminated benzene, toluene and xylene, it is not difficult to meet these EPA requirements at relatively low combustion temperatures. However, relatively small amounts of these hazardous wastes need to be destroyed because they are usually used over and over again in a particular operation, such as degreasing, or the like.

Certain other hazardous wastes which are less volatile and more stable chemically, such as polyurethane, require a considerably high temperature to be broken down into their constituent elements. Other hazardous wastes may contain various amounts of chlorine, bromine, or other of the halogens, which will also affect the temperature to which the waste must be brought to obtain partial or complete combustion thereof. Still other hazardous wastes which are extremely stable chemically, such as the highly toxic polychlorinated bi-phenyls, commonly called PCB's, require an extremely high temperature, in the order of 4500° F., in order to be broken down into their decomposition products and oxidized sufficiently to comply with the EPA standards regarding destruction efficiency of such hazardous wastes. As a result, the EPA has not yet given anyone permission to incinerate PCB's. Although the EPA banned the manufacture of PCB's several years ago, this material continues to be used as insulation in electrical devices and for fire resistance in hydraulic fluids. Accordingly, thousands of tons of this material are piling up in storage facilities around the country because no approved economical process is available for their destruction.

Conventional incinerators are either incapable of achieving the sustained high temperature environment necessary to breakdown these stable compounds, or require such large amounts of fossil fuel to achieve the desired temperature level that the incineration process becomes prohibitively expensive.

STATEMENT OF THE PRIOR ART

Many types of incineration systems have been heretofore proposed which are capable of incinerating hazardous wastes at relatively low temperatures. Certain of these prior art systems have employed multiple combustion chambers or stages in an attempt to provide more complete incineration. Examples of such prior art multiple chamber arrangements are shown in Stookey U.S. Pat. No. 3,511,194, Lambiris U.S. Pat. No. 3,601,070, Bruns et al. U.S. Pat. No. 3,604,375, Krumm U.S. Pat. No. 3,766,866, Katz U.S. Pat. No. 3,881,430, Pillard U.S. Pat. No. 3,885,919, Yamamoto et al. U.S. Pat. No. 3,918,374 and Lachsinger et al. U.S. Pat. No. 4,050,387. In addition, multi-chambered kilns which were originally developed in China have been used for many years in the firing of pottery and ceramics. Such oriental multi-chambered kilns are described, for example, in the book Kilns-Design, Construction and Operation, by Daniel Roades, Chilton Book Company, Philadelphia.

SUMMARY OF THE INVENTION

Briefly, in accordance with the present invention a series of interconnected combustion chambers are employed to obtain successively higher temperatures in successive chambers, the gaseous products of combustion in each chamber being supplied to the next chamber in the series to act as a high temperature environment and promote the burning of hazardous wastes in successive chambers which require successively higher temperatures to become volatilized and break down into their constituent elements. In a preferred embodiment, a number of such series of interconnected chambers are provided and the final chamber in each series is arranged to supply its gaseous products of combustion to a large central combustion chamber so that an extremely high temperature environment is provided in said central chamber. A large amount of a highly stable compound such as PCB, which requires such a high temperature environment to be broken down into its constituent elements, may then be burned in this central chamber in the presence of a suitable quantity of preheated air. Preferably, the successive chambers in each series have successively larger volumes so that successively greater amounts of hazardous wastes, which may be of successively lower heat values and require successively higher temperatures to be broken down, may be burned in successive combustion chambers in each series. With the arrangement of the present invention the hazardous waste supplied to each chamber is the only source of fuel supplied to the chamber, apart from the fuel necessary initially to bring the chamber up to a temperature at which the particular hazardous waste supplied thereto will burn. Since the size of the chambers is progressively increased in each series, progressively larger amounts of hazardous wastes may be burned which require progressively higher temperatures to ignite, the largest amount of hazardous waste being burned in the central chamber without the use of fossil fuel by employing the outputs of several series of combustion chambers to provide the sustained high temperature environment necessary to break down stable compounds such as PCB. Accordingly, an economical and efficient process for destroying hazardous wastes up to and including those wastes which are extremely stable chemically is provided by the present invention.

It is, therefore, an object of the present invention to provide a new and improved method of disposing of hazardous wastes which comprises the steps of burning a highly combustible hazardous waste in a furnace combustion chamber, supplying the gaseous products of combustion produced in said first combustion chamber to a second combustion chamber to act as a high temperature environment therein, and burning a hazardous waste in said second combustion chamber at a higher temperature than the temperature of the gaseous products of combustion supplied from said first chamber.

It is another object of the present invention to provide a new and improved method of disposing of hazardous wastes which comprise the steps of supplying hazardous wastes to each one of a series of combustion chambers to act as the primary source of combustion in each chamber, and supplying the gaseous products of combustion of each chamber to the next chamber in said series to act as a high temperature environment and promote the burning of hazardous wastes in said series of combustion chambers at successively higher temperatures.

It is a further object of the present invention to provide a new and improved method of disposing of hazardous wastes which comprises the steps of burning a highly combustible hazardous waste in a first relatively small combustion chamber, supplying the gaseous products of said first combustion chamber to a second combustion chamber of substantially larger volume while limiting the outflow from said second chamber so that the output of the first chamber acts as a sustained high temperature environment in said second chamber, and burning a larger volume of hazardous waste which is somewhat less combustible than said first highly combustible hazardous wate in said second chamber at a higher temperature than the temperature of the gaseous products of combustion supplied from said first chamber.

The invention, both as to its organization and method of operation, together with further objects and advantages thereof, will best be understood by reference to the following specification taken in connection with the accompanying drawings, in which.

Figures 1, 2, 3:
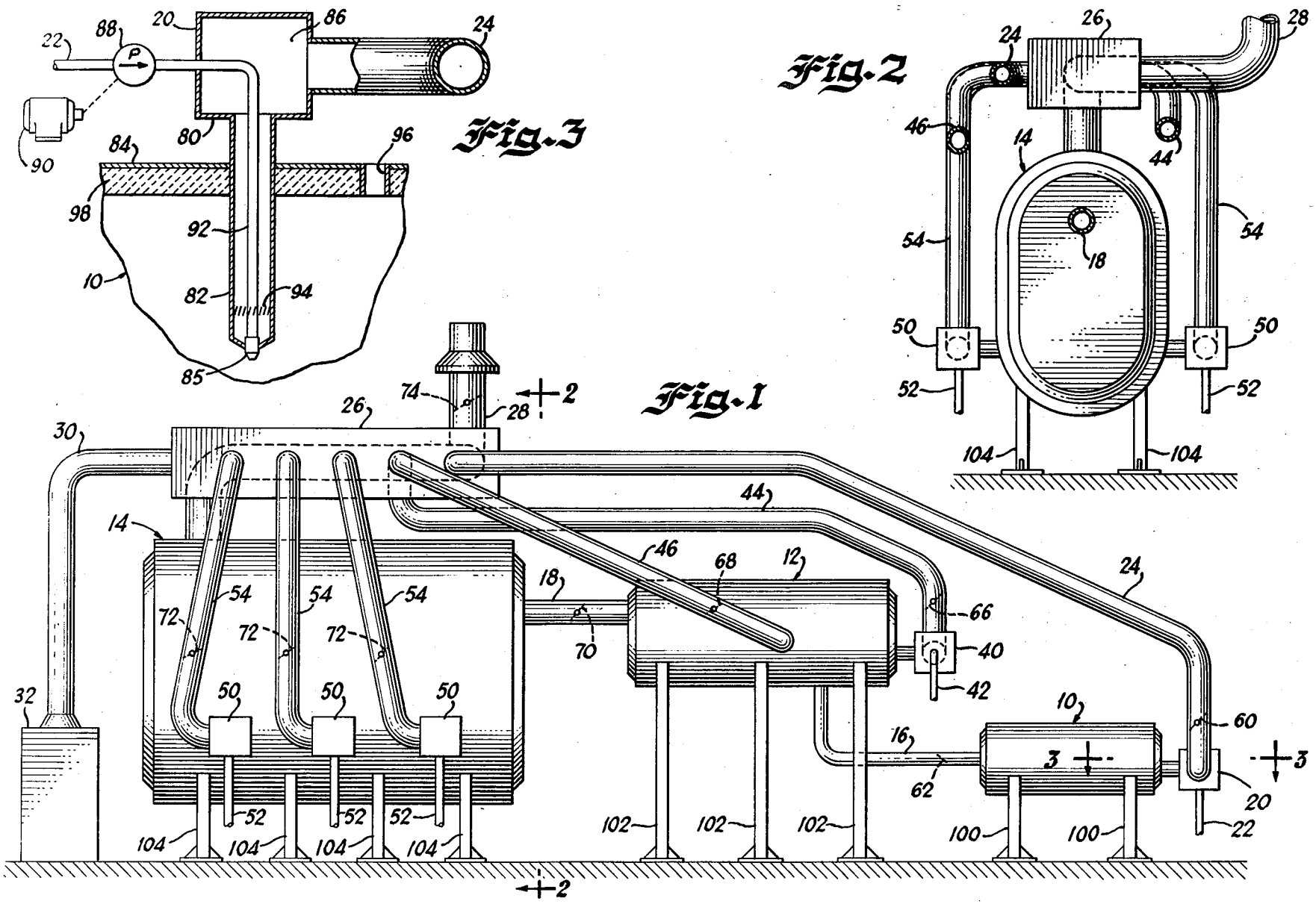
FIG. 1 is a side elevational view of an incineration system for hazardous wastes embodying the features of the present invention.
FIG. 2 is a sectional view taken along the lines 2—2 of FIG. 1.
FIG. 3 is a sectional view taken along the lines 3—3 of FIG. 1 showing one of the burner arrangements employed in the system of FIG. 1.

Referring now to the drawings, and more particularly to FIGS. 1 and 2 thereof, the present invention is therein illustrated as comprising a series of combustion chambers 10, 12 and 14. The gaseous products of combustion developed in each chamber are supplied to the next chamber in the series so as to provide a high temperature environment within that chamber and promote the burning of successively less combustible hazardous wastes in the series of chambers at successively higher temperatures. More particularly, the gaseous products of combustion developed in the chamber 10 are supplied through the conduit 16 to chamber 12 and the gaseous products of combustion developed in the chamber 12 are supplied through the conduit 18 to the chamber 14.

Each of the combustion chambers in the series is provided with a suitable burner arrangement to which a particular hazardous waste, or combination of hazardous wastes, is supplied under pressure together with a suitable quantity of preheated air to promote complete combustion of the hazardous waste within the particular chamber. Thus, the burner 20 is provided for the chamber 10, a highly combustible low viscosity hazardous waste being supplied to the burner 20 from a suitable storage tank arrangement through the inlet 22. Preheated air is supplied to the burner 20 through the conduit 24, this preheated air in the illustrated embodiment being derived from a heat exchanger 26 which surrounds the outlet flue 28 of the largest combustion chamber 14. Air under pressure is supplied to the heat exchanger 26 through the inlet 30 from the source 32. Preferrably the source 32 includes an LP gas preheat furnace for initially preheating the air supplied to the heat exchanger during start up of the incineration system, as will be described in more detail hereinafter. The air supplied to the inlet 30 of the heat exchanger 26 is heated in passing over the flue 28, preferrably to a temperature of from 400° to 500° F.

A burner 40 is provided for the combustion chamber 12, the hazardous waste material which is to be burned in the chamber 12 being supplied from a suitable storage tank arrangement through the inlet 42 to the burner 40. Preheated air is also supplied from the heat exchanger 26 to the burner 40 through the conduit 44. In order to supply sufficient air to the chamber 12 to completely burn the hazardous waste material supplied through the inlet 42, preheated air is also supplied over the conduits 46 to both sides of the chamber 12.

In order to burn a relatively large amount of low heat value hazardous waste material in the largest chamber 14 a series of six burners 50 are provided, three on each side of the chamber 14. The hazardous waste material to be burned in the chamber 14 is supplied from a suitable storage tank arrangement through the inlets 52 to the burners 50 and preheated air is supplied to these burners through the conduits 54 from the heat exchanger 26.

In accordance with an important aspect of the present invention, the temperature within each chamber in the series is maximized by carefully controlling the air supplied to each chamber to stoichiometric value, i.e. the amount of air, calculated from the chemical composition of the waste, that is required to completely burn the waste. The gaseous products of combustion from each chamber, whose temperature has thus been maximized, are then supplied to the next chamber in the series to provide a high temperature environment for burning a larger amount of hazardous waste of lower heat value at a higher temperature in the succeeding chamber. More particularly, a damper 60 is provided in the preheated air inlet 24 to the burner 20 and a damper 62 is provided in the outlet conduit 16 of the combustion chamber 10, these dampers being controlled, either manually or by suitable automatic control apparatus, so that the air supplied to the chamber 10 is of stoichiometric value. The stoichiometric value may, for example, be determined by inserting suitable probes in the conduit 16 downstream of the damper 62 and measuring both the $O_2$ and $CO_2$ content of the gaseous products of combustion. When stoichiometric value is reached the $O_2$ reading should be reduced to zero and the $CO_2$ reading should be maximized.

In a similar manner a damper 66 is provided in the preheated air inlet 44 and dampers 68 are provided in the inlets 46 to the chamber 12 to control the amount of preheated air supplied to the chamber 12. A damper 70 is provided in the output conduit 18 of the chamber 12 to limit the outflow from the chamber and increase the retention time of the hot gases in the chamber 14 including the gaseous products of combustion supplied from the chamber 10. The dampers 66, 68, and 70 are suitably controlled so that stoichiometric air is supplied to the chamber 12 and the temperature within the combustion chamber 12 is also maximized at a somewhat higher value than the temperature of the combustion chamber 10 due to the fact that substantial additional heat is added in the chamber 12 due to the combustion of the hazardous waste material supplied through the inlet 42 to the burner 40.

Dampers 72 are provided in each of the preheated air inlets 54 to the chamber 14 and the damper 74 is provided in the flue 28 of the chamber 14, these dampers being controlled so that stoichiometric air is supplied to the chamber 14 and the temperature of the combustion process within the chamber 14 is maximized at a still higher temperature than that of the combustion chamber 12 again due to the fact that additional heat is added to the chamber 14 by the incineration of a large amount of hazardous waste material supplied through the inlets 52 to the burners 50, even though the heat value of this hazardous waste material may be much less than the hazardous wastes supplied to the combustion chambers 10 and 12.

In accordance with an important aspect of the present invention the combustion chambers 10, 12 and 14 are of succesively larger volumes and the conduits 16 and 18 are of successively larger diameters so that successively larger amounts of hazardous wastes, which may have progressively less heat value, may be burned at successively higher temperatures in the series of combustion chambers. For example, the combustion chamber 10 may have a volume of, for example, 6 to 7 cu. ft. such that a maximum of three gallons per hour of low viscosity high heat value liquid hazardous waste may be burned in the chamber 10 at a temperature of approximately 2,300° F. The chamber 12 may, in turn, have a sufficiently larger volume of, for example, 23 cu. ft. that a maximum of ten gallons per hour of hazardous waste may be supplied to the burner 40 and burned in the chamber 12 at a temperature of approximately 2,700° F. In a similar manner the combustion chamber 14 may have a substantially greater volume of, for example, 144 cu. ft. so that a maximum of approximately 60 gallons per hour of hazardous waste supplied to burners 50 from the inlets 52 may be substantially completely incinerated in the chamber 14. It will thus be appreciated that the incineration system of the present invention requires only a relatively small amount of low viscosity, high heat value hazardous wastes to be burned in the chamber 10 and yet provides the high temperature environment for the chamber 12 so that much larger amounts of hazardous wastes may be burned in the chamber 12 which may be of higher viscosity and have lower heat value than the hazardous waste supplied to the chamber 10. In a similar manner the chamber 12 acts as a high temperature environment for the chamber 14 so that much larger amounts of hazardous waste, which may have even greater viscosity and/or lower heat value than the hazardous waste supplied to the chamber 12, may be burned within the chamber 14. This is particularly important because only a relatively small amount of highly combustible hazardous waste of low viscosity is available due to the fact that such hazardous waste is reused many times before it is thrown out. This hazardous waste, for example, may comprise highly combustible liquids, such as toluene, benzene and xylene contaminated with one or more elements such as lead, zinc, lithium or copper which are normally used in degreasing operations, and the like. On the other hand, large amounts of hazardous wastes which are of lower heat value and require higher temperatures to be burned exist in storage dumps throughout the country and are being generated in large amounts on a daily basis. The incineration system of the present invention thus provides a means for destroying large amounts of the hazardous waste which now remain to be disposed of throughout the country without requiring the use of large amounts of fossil fuel, or large amounts of highly combustible hazardous wastes which can be used as fuel, so that an extremely economical system is provided for destroying large amounts of hazardous wastes in accordance with the present invention. In this connection, it is pointed out that more than three combustion chambers may be connected in series, depending upon conditions in a particular hazardous waste destruction area. For example, if a very small amount of highly combustible hazardous waste having low contamination is available on a daily basis, a combustion chamber may be provided ahead of the chamber 10 whose outlet flue gases are supplied to the chamber 10. This first chamber would have a maximum capacity of, for example, one gallon per hour with a burner similar to the burner 20 and supply gaseous products of combustion to the chamber 10 at a temperature of say 2100° F. The chamber 10 could then burn 3 gallons per hour of a hazardous waste which included more contaminants, or a higher percentage of lower heat value material than if the chamber 10 were the first chamber in the series.

The incineration system of the present invention also provides enormous amounts of energy in the form of heat developed during the burning of these hazardous wastes in the chambers 10, 12 and 14. More particularly, the outlet flue 28 of the chamber 14 may be supplied through suitable scrubbing apparatus to a suitable heat exchanging apparatus for the generation of steam from which electricity may be generated or other forms of energy derived. The output of the stack 28 is then supplied to suitable coolint trays so that various contaminants may be removed from the flue gases before they are discharged into the atmosphere, as will be readily understood by those skilled in the art.

While the various types of hazardous wastes which may be burned in the combustion chambers 10 and 12 and 14 are virtually unlimited, the following are given as examples of particular categories of hazardous wastes which may be burned in each of these chambers, these hazardous wastes being given by both the EPA hazardous waste number and the definition assigned thereto by the EPA:

| IN THE CHAMBER 10 | |
|---|---|
| H.W. No. | Description |
| F001 | The spent halogenated solvents used in degreasing, tetrachloroethylene, trichloroethylene, methylene chloride, 1,1,1-trichloroethane, carbon tetrachloride, and the chlorinated fluorocarbons; and sludges from the recovery of these solvents in degreasing operations. |
| F002 | The spent halogenated solvents, tetrachloroethylene, methylene chloride, trichloroethylene, 1,1,1-trichloroethane, chlorobenzene, 1,1,2-trichlor-1,2,2-trifluoroethane, o-dichlorobenzene, trichlorofluoromethane and the still bottoms from the recovery of these solvents. |

-continued

| IN THE CHAMBER 10 | |
|---|---|
| H.W. No. | Description |
| F003 | The spent non-halogenated solvents, xylene, acetone, ethyl acetate, ethyl benzene, ethyl ether, n-butyl alcohol, cyclohexanone, and the still bottoms from the recovery of these solvents. |
| F004 | The spent non-halogenated solvents, cresols and cresylic acid, nitrobenzene, and the still bottoms from the recovery of these solvents |
| F005 | The spent non-halogenated solvents, methanol, toluene, methyl ethyl ketone, methyl isobutyl ketone, carbon disulfide, isobutanol, pyridine and the still bottoms from the recovery of these solvents. |
| F009 | Spent stripping and cleaning bath solutions from electroplating operations. |
| K009 | Distillation bottoms from the production of acetaldehyde from ethylene |
| K010 | Distillation side cuts from the production of acetaldehyde from ethylene |
| K011 | Bottom stream from the wastewater stripper in the production of acrylonitrile |
| K012 | Still bottoms from the final purification of acrylonitrile in the production of acrylonitrile |

| IN THE CHAMBER 12 | |
|---|---|
| H.W. No. | Description |
| K010 | Distillation side cuts from the production of acetaldehyde from ethylene |
| K011 | Bottom stream from the wastewater stripper in the production of acrylonitrile |
| K012 | Still bottoms from the final purification of acrylonitrile in the production of acrylonitrile |
| K013 | Bottom stream from the acetonitrile column in the production of acrylonitrile |
| K014 | Bottoms from the acetonitrile purification column in the production of acrylonitrile |
| K015 | Still bottoms from the distillation of benzyl chloride |
| K016 | Heavy ends or distillation residues from the production of carbon tetrachloride |
| K023 | Distillation light ends from the production of phthalic anhydride from naphthalene |
| K024 | Distillation bottoms from the production of phthalic anhydride from naphthalene |
| K025 | Distillation bottoms from the production of nitrobenzene by the nitration of benzene |
| K048 | Dissolved air flotation (DAF) float from the petroleum refining industry |

| IN THE CHAMBER 14 | |
|---|---|
| H.W. No. | Description |
| K017 | Heavy ends (still bottoms) from the purification column in the production of epichlorohydrin |
| K018 | Heavy ends from fractionation in ethyl chloride production |
| K019 | heavy ends from the distillation of ethylene dichloride in ethylene dichloride production |
| K026 | Stripping still tails from the production of methyl ethyl pyridines |
| K028 | Spent catalyst from the hydrochlorinator reactor in the production of 1,1,1-trichloroethane |
| K050 | Heat exchanger bundle cleaning sludge from the petroleum refining industry |
| K051 | API separator sludge from the petroleum refining industry |

In connection with the above listed hazardous wastes, it will be noted that certain categories of hazardous wastes are listed as being supplied to either the combustion chamber 10 or the combustion chamber 12, depending upon the viscosity and heat value of the particular waste which is to be incinerated. It should also be understood that the hazardous wastes which are burned in the higher temperature chambers 12 and 14 will be at least partially combustible at the temperature of the incoming flue gases from the previous chamber so that additional heat is provided by the exothermic combustion process within the chamber to raise the temperature by the desired amount. This additional heat must also be sufficient to provide substantially complete combustion of the hazardous waste supplied to the higher temperature chambers on a continuing basis.

Considering now in more detail the burner arrangement which may be employed for each of the combustion chambers 10, 12 and 14, in FIG. 3 there is shown a suitable burner arrangement for supplying low viscosity liquid hazardous waste of relatively high heat value in atomized form to the combustion chamber 10. More particularly, the burner 20 comprises a housing 80 which includes a portion 82 which extends through the side wall 84 of the combustion chamber 10, a suitable atomizing nozzle 85 being positioned in the end of the portion 82. For example, the nozzle 85 may comprise a 60° hollow core nozzle, although various types of nozzles may be required, depending upon the viscosity fo the hazardous waste and the amount of solids suspended therein. Preheated air which is supplied through the conduit 24 is connected to the hollow chamber portion 86 of the burner 20 and the liquid hazardous waste is supplied from the conduit 22 through the pump 88, which is driven by the motor 90, and through the tubing 92 which is positioned centrally of the portion 82, to the nozzle 85. In order to obtain good turbulence of the air fuel mixture a stationary fan element 94 is positioned in the end of the portion 82 adjacent the nozzle 85. Upon start up, air supplied through the conduit 24 which has been heated by the LP gas heater in the unit 32. After the chamber has been brought up to the temperature of the heated air, fuel is supplied to the inlet line 22. At the same time the air fuel mixture may be ignited within the chamber 10 by any suitable means. For example, a portable flame unit may be inserted through the opening 96 in the side wall 84 of the chamber 10. In the alternative, any other suitable form of starting arrangement, such as an electric spark starter, or the like, may be employed.

The combustion chamber 10 may comprise a steel tank which is preferably lined with a multi-layer ceramic refractory lining 98. In the illustrated embodiment the combustion chamber 10 is supported on legs 100 and is positioned so that the outlet flue 16 thereof enters the bottom of the chamber 12. The chamber 12 is supported on the legs 102 and its outlet flue 18 extends directly into the side of the combustion chamber 14, this chamber being supported on the legs 104. The combustion chamber 14 is preferrably lined with multiple layers of zirconia to withstand the relatively high temperatures encountered therein. The chambers 10 and 12 may be lined with alumina, or other suitable refractory material. It will, of course, be understood that other suitable arrangements may be employed for the construction and interconnection of the combustion chambers 10, 12 and 14. In this connection it should be noted that other heat exchanger arrangements may be employed to provide preheated air for combustion chambers 10, 12 and 14, as will be readily understood by those skilled in the art. For example, a heat exchanger may be provided around the conduit 18 between the chambers 12 and 14, in addition to or in place of the heat exchanger 26. Other arrangements may obviously be employed to provide the necessary preheated air for these combustion chambers so that they are each operated at stoichiometric value.

Figure 4:
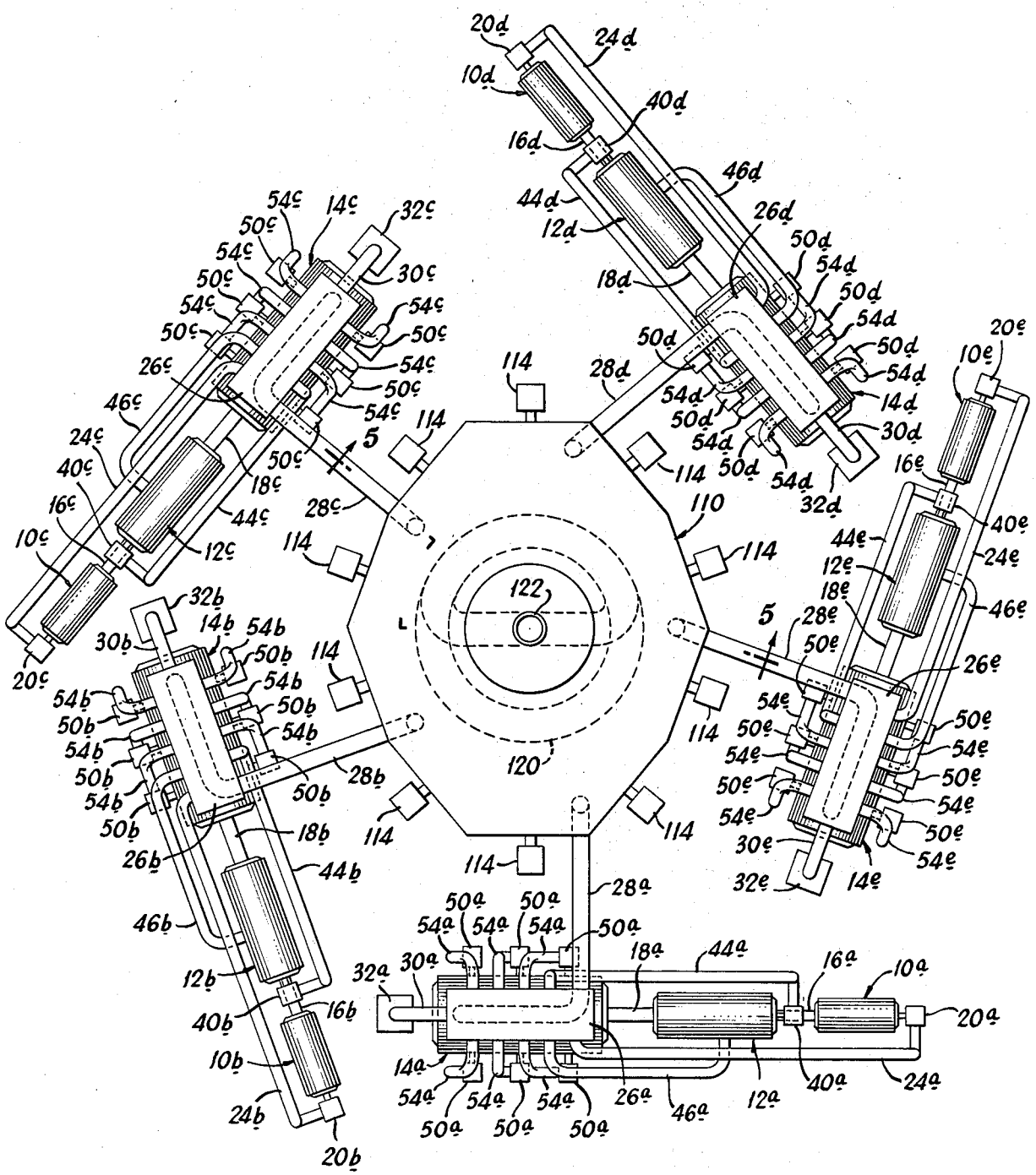
FIG. 4 is a plan view of an alternative embodiment of the incineration system of the present invention wherein extremely high temperatures may be achieved for the incineration of highly stable chemical compounds.
Figure 5:
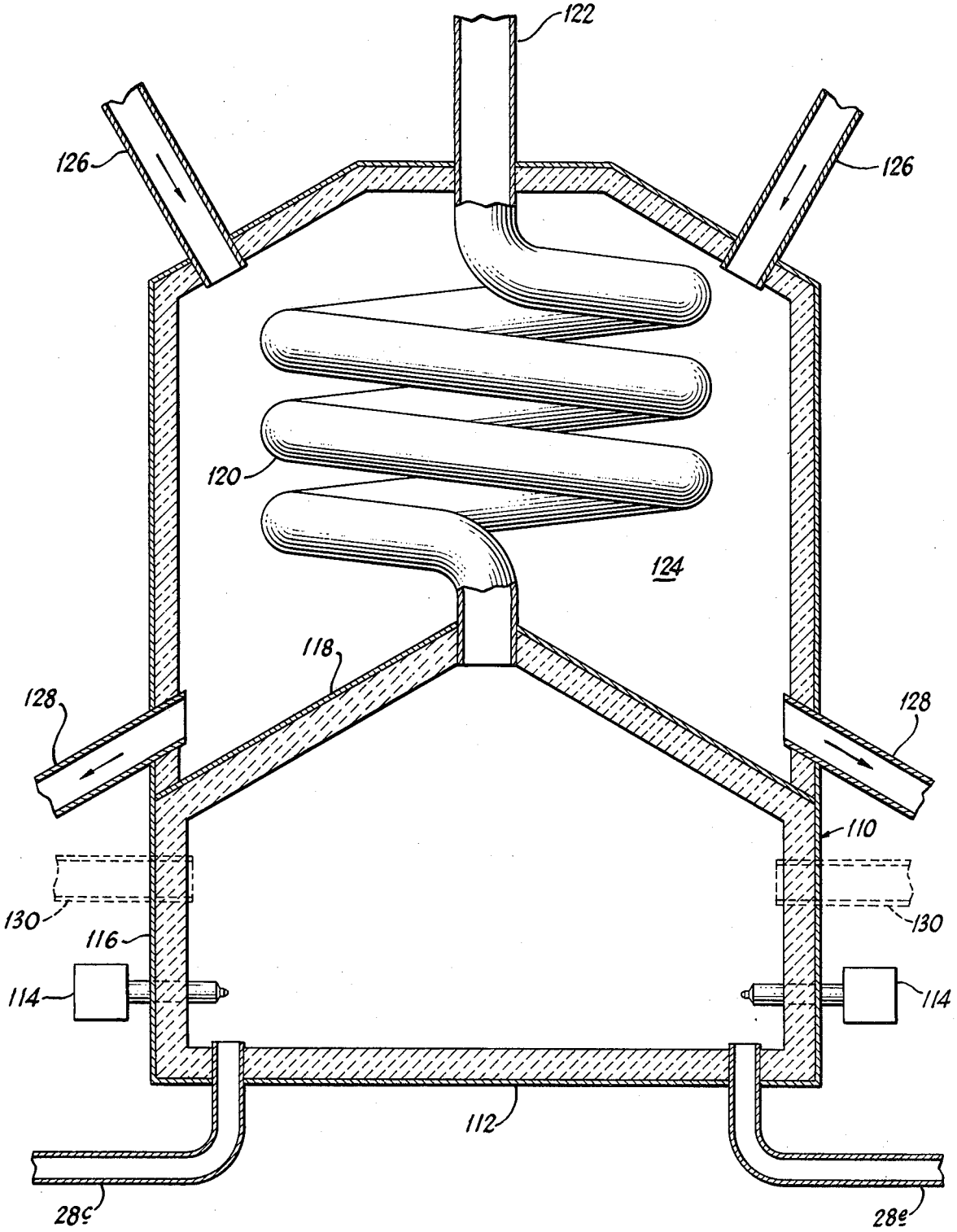
FIG. 5 is a sectional view taken along the line 5—5 of FIG. 4.

In FIGS. 4 and 5 an alternative embodiment of the invention is shown wherein extremely high temperatures in the order of 4,500° F. may be attained in a central combustion chamber so that large quantities of very stable chemical compounds, such as polychlorinated biphenyls may be incinerated in this chamber. Referring to these FIGS., a number of groups of series connected combustion chambers are arranged to supply a large central combustion chamber indicated generally at 110. Each of these series of combustion chambers may be substantially identical to the series described in detail heretofore in connection with FIGS. 1 and 2. Thus, a first series of combustion chambers 10*a*, 12*a*, and 14*a* are provided, the outlet flue 28*a* of the combustion chamber 14*a* being arranged to supply the gaseous products of combustion developed in the chamber 14*a* to the chamber 110. In this series of chambers the burner 20*a* is provided to supply hazardous waste to be incinerated in the combustion chamber 10*a*, the burner 40*a* being provided for the combustion chamber 12*a* and the series of six burners 50*a* being provided for the combustion chamber 14*a*. A heat exchanger 26*a* surrounds the outlet flue 28*a*, and is employed to supply preheated air to the combustion chambers 10*a* and 12*a* in a manner identical to that described in detail heretofore in connection with FIG. 1. Other elements of this series of combustion chambers have been given the same reference numerals as the corresponding elements in FIG. 1.

The second series of combustion chambers 10*b*, 12*b* and 14*b* are arranged to provide the gaseous products of combustion of the chamber 14*b* to the central combustion chamber 110 through the conduit 28*b* at a temperature of approximately 3,100° F. In a similar manner the series of combustion chambers 10*c*, 12*c* and 14*c* supply the products of combustion of the chamber 14*c* to the central chamber 110 through the conduit 28*c*, the series of chambers 10*d*, 12*d* and 14*d* supply the central chamber 110 through the conduit 28*d* and the series of chambers 10*e*, 12*e* and 14*e* supply the central chamber 110 through the conduit 28*e*. The conduits 28*a*–28*e* are arranged to supply gaseous products of combustion to the chamber 110 through the bottom wall 112 thereof, as best illustrated in FIG. 5. A series of ten burners 114 are spaced about the periphery of the central chamber 110 and are positioned on the sidewall 116 of this chamber so as to supply atomized hazardous waste of low heat value to the central chamber 110 in large quantities. Preferrably, the burners 114 are of the same general construction as the burner 20 described in detail heretofore in connection with FIG. 2, but are of much larger capacity so that each burner 114 is capable of supplying from 30 to 50 gallons per hour of hazardous waste material to the central chamber 110. Preferrably, this hazardous waste material includes a large amount of extremely stable chemical compounds, such as PCB, so that large quantities of this inert material may be incinerated in the central chamber 110 due to the extremely high temperature environment produced therein by the flue gases supplied from all of the surrounding series of combustion chambers. The chamber 110 is provided with a conical top portion 118, the exhaust gases from the chamber 110 being supplied through the coiled heat exchange pipe 120 to the flue stack 122 of the central chamber 110. Large quantities or air may be forced through the chamber 124 in which the coil 120 is positioned, through the inlets 126 so that large quantities of heated air may be exhausted through the conduits 128 and employed to develop steam for generation of electricity and other purposes. The flue stack 122 communicates with suitable scrubbing apparatus and cooling trays so as to provide a flue discharge which can be exhausted to the atmosphere, as will be readily understood by those skilled in the art. Preferably, the temperature of the exhaust gases in the chamber 124 is reduced by traveling through the heat exchange coil 124 so that the gases in the central flue 120 are below 1,500° F. If desired, preheated air may be supplied to the central combustion chamber 110 through the conduits 130 (see FIG. 4).

While there have been illustrated and described various embodiments of the present invention, it will be apparent that various changes and modifications thereof will occur to those skilled in the art. It is intended in the appended claims to cover all such changes and modifications as fall within the true spirit and scope of the present invention.

What is claimed as new and is desired to be secured by Letters Patent of the United States is:

1. The method of disposing of hazardous wastes which comprises the step of, burning low viscosity, high heat value liquid hazardous waste at a relatively slow rate in a first combustion chamber, supplying the gaseous products of combustion to a second combustion chamber to act as a sustained high temperature environment therein, and burning in said second chamber at a substantially increased rate liquid hazardous waste of somewhat less heat value than the hazardous waste burned in said first chamber.

2. The method of claim 1, wherein the liquid waste supplied to said second chamber is burned at a temperature higher than the temperature at which the liquid waste supplied to said first chamber is burned.

3. The method of claim 1, which includes the steps of supplying the gaseous products of combustion of said second chamber to a third chamber to act as a sustained high temperture environment therein, said high temperature environment in said third chamber being of higher temperature than said high temperature environment in said second chamber.

4. The method of claim 3, which includes the step of burning liquid hazardous waste in said third chamber at a rate substantially greater than the rate at which hazardous waste is burned in either of said first and second chambers.

5. The method of disposing of hazardous waste, which comprises the steps of burning hazardous waste in a first combustion chamber at a relatively slow rate, supplying the gaseous products of combustion of said first chamber to a second combustion chamber to act as a sustained high temperature environment and promote the burning of hazardous waste therein, and burning hazardous waste in said second combustion chamber at a rate substantially greater than the rate at which hazardous waste is burned in said first combustion chamber.

6. The method of claim 5, which includes the step of supplying the gaseous products of combustion of said second combustion chamber to a third combustion chamber to act as a sustained high temperature environment therein and promote the burning of hazardous waste, and burning hazardous waste in said third combustion chamber at a rate substantially greater than the rate at which hazardous waste is burned in said second combustion chamber.

7. The method of claim 6, wherein said first, second and third combustion chambers are of successively larger volume.

8. The method of claim 5, wherein hazardous waste is burned in said first combustion chamber at a rate in the order of three gallons per hour.

9. The method of claim 5, wherein hazardous waste is burned in said second combustion chamber at a rate in the order of ten gallons per hour.

10. The method of claim 6, wherein hazardous waste is burned in said third combustion chamber at a rate in the order of sixty gallons per hour.

11. The method of claim 5, wherein the hazardous waste material burned in said first combustion chamber is a low viscosity liquid have relatively high heat value per unit volume.

12. The method of claim 11, wherein the hazardous waste material burned in said second combustion chamber has a heat value somewhat less than the hazardous waste which is burned in said first combustion chamber.

13. The method of claim 6, wherein the hazardous waste material burned in said third combustion chamber has a heat value somewhat less than the hazardous waste which is burned in said first and second combustion chambers.

14. The method of claim 1, which includes the step of supplying air to each of said first and second combustion chambers in an amount slightly less than that stoichiometrically required to completely burn the hazardous waste supplied to each of said chambers.

15. The method of claim 14, wherein the air supplied to at least one of said first and second chambers is preheated.

16. The method of claim 5, which includes the step of supplying air to each of said first and second combustion chambers in an amount close to the stoichiometric value, thereby to maximize the temperature within each of said chambers.

17. The method of claim 5, which includes the step of supplying air to each of said first and second combustion chambers in an amount slightly less than that stoichiometrically required to completely burn the hazardous waste supplied to each of said chambers.

18. The method of claim 16, wherein the air supplied to at least one of said first and second chambers is preheated.

* * * * *